US006058898A

United States Patent [19]

Freese, V

[11] Patent Number: 6,058,898

[45] Date of Patent: May 9, 2000

[54] STRUCTURAL OIL PAN WITH INTEGRATED OIL FILTRATION AND COOLING SYSTEM

[75] Inventor: Charles Edwin Freese, V, Westland, Mich.

[73] Assignee: Detroit Diesel Corporation, Detroit, Mich.

[21] Appl. No.: 09/228,080

[22] Filed: Dec. 28, 1998

[51] Int. Cl.[7] ..... F02F 7/00

[52] U.S. Cl. ..... 123/195 C; 123/196 AB; 184/104.3; 184/106

[58] Field of Search ..... 123/195 C, 196 AB, 123/41.33; 184/106, 104.3, 6.22

[56] References Cited

U.S. PATENT DOCUMENTS 4,541,368 9/1985 Castarede ..... 123/196 AB
5,168,845 12/1992 Peaker ..... 123/196 AB
5,199,395 4/1993 Mizumura et al. ..... 123/196 AB
5,647,315 7/1997 Saito ..... 123/196 AB

*Primary Examiner*—John Kwon
*Attorney, Agent, or Firm*—Bill C. Panagos

[57] ABSTRACT

An oil pan for an internal combustion engine includes a body defining a reservoir for collecting engine coolant. The reservoir has a bottom and side walls extending upwardly from the bottom to present a flanged lip through which the oil pan may be mounted to the engine. An oil cooler assembly is housed within the body of the oil pan for cooling lubricant received from the engine. The body includes an oil inlet passage formed integrally therewith for receiving lubricant from the engine and delivering lubricant to the oil cooler. In addition, the body also includes an oil pick up passage formed integrally therewith for providing fluid communication between the reservoir and the engine through the flanged lip.

16 Claims, 2 Drawing Sheets

STRUCTURAL OIL PAN WITH INTEGRATED OIL FILTRATION AND COOLING SYSTEM

BACKGROUND OF THE INVENTION

1. Field of the Invention

The present invention is generally directed toward internal combustion engines and, more specifically, to an internal combustion engine having an improved structural oil pan.

2. Description of the Related Art

Internal combustion engines known in the related art typically include, among other basic components, a cast engine block, a head mounted to the engine block and a valve cover fastened to the head. A plurality of pistons are reciprocated in cylinders formed in the engine block. Similarly, a plurality of valves supported in the head are opened and closed via rocker arms, cams or some other mechanism to provide fluid communication between the cylinders and intake and exhaust manifolds. Fuel is combusted within the cylinders to reciprocate the pistons which, in turn, act on a crankshaft from which power may be translated to drive an automotive vehicle or any number of other devices.

The various moving parts in an internal combustion engine need to be lubricated and cooled. To this end, coolant is circulated through the engine block and lubricant, such as engine oil, is splashed over the moving parts. Thereafter, the lubricant moves through the engine under the force of gravity and is collected in an oil pan that is fixed to the underside of the engine block. The lubricant is pumped from the oil pan up into the head and engine block via pick up tubes communicating with the oil pan. The lubricant must also be filtered and cooled and most engines employ separate oil filters and coolers which are plumbed into the lubrication circuit via various tubes and housings supported by brackets and seals associated with the engine.

Modern internal combustion engines often typically require engineered components to limit noise and vibrations. This is especially true of diesel engines, some of which require a high degree of noise and vibration attenuation to remain competitive in certain markets. The engine oil pan is a significant noise radiation source in a diesel engine. To limit the noise radiation from this source, special materials or composites may be employed for the oil pan which dampen engine noise. Alternatively, the oil pan may be stiffened or weakened to shift the natural vibration frequencies for the oil pan outside the excitation frequency range for the engine. In this way, the noise from the oil pan may be minimized.

However, in some engines, especially heavy duty applications, the oil pan serves as a structural member for the engine and associated transmission. In such situations, the oil pan must be stiffened, rather than weakened. Further, in these cases, most noise dampening materials and composites are not practical for such applications.

Thus, there is a need in the art for improved noise and vibration attenuation for internal combustion engines and especially such attenuation through the oil pan on diesel engines. In addition to noise and vibration attenuation, there is a constant need to simplify systems and reduce components to reduce costs and streamline the manufacturing process for internal combustion engines.

SUMMARY OF THE INVENTION

The subject invention overcomes the disadvantages in the related art in an oil pan for an internal combustion engine having a body defining a reservoir for collecting engine lubricant. The reservoir has a bottom and side walls extending upwardly from the bottom to present a flanged lip. The flanged lip serves as a mechanism through which the oil pan may be mounted to the engine. The oil pan further includes an oil cooler assembly housed within the body of the reservoir for cooling the lubricant received from the engine. The body also includes an oil inlet passage formed integrally therewith for receiving lubricant from the engine and for delivering lubricant to the oil cooler. In addition, the body further includes an oil pick up passage formed integrally therewith which provides fluid communication between the reservoir and the engine through the flanged lip. An oil filter may be removably mounted directly to the body of the oil pan. In this regard, oil filter passages may be formed integrally with the body and provide fluid communication for lubricant traveling between the oil cooler assembly and the oil filter.

The fluids that are conducted through the body of the oil pan serve to deaden engine noise. The oil pick up, oil inlet and oil filter passages formed integrally with the body of the oil pan create ribs that serve to strengthen and stiffen the oil pan such that the natural vibration frequencies for the oil pan are shifted outside the excitation frequency range for the engine. At the same time, a number of components and sub-components normally associated with the oil cooler and oil filter systems may be eliminated. More specifically, the present invention eliminates the need for a separate oil cooler housing, a separate oil filter housing as well as tubing, seals gaskets, clamps, brackets, and fasteners associated with these housings. The present invention also minimizes the opportunity for external leaks when compared with conventional oil pans. Thus, the present invention not only reduces engine noise radiated from the oil pan, it results in fewer components, reduced assembly time, increased manufacturing efficiencies and thereby reduces overall costs for the oil system.

Accordingly, one advantage of the present invention is that an improved structural oil pan is provided.

Another advantage of the present invention is that the oil pan effectively deadens noise and vibration radiating from the engine through the oil pan.

Another advantage of the present invention is that it integrates the oil cooler and oil filter systems into the oil pan.

Another advantage of the present invention is that the heat from the oil is transferred to the engine coolant to aid in engine warm-up for reduced emissions.

Still another advantage of the present invention is that it eliminates a number of components as well as associated plumbing, brackets, tubes, clamps, gaskets, seals and fasteners, thereby simplifying the oil cooler as well as the oil filter systems.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
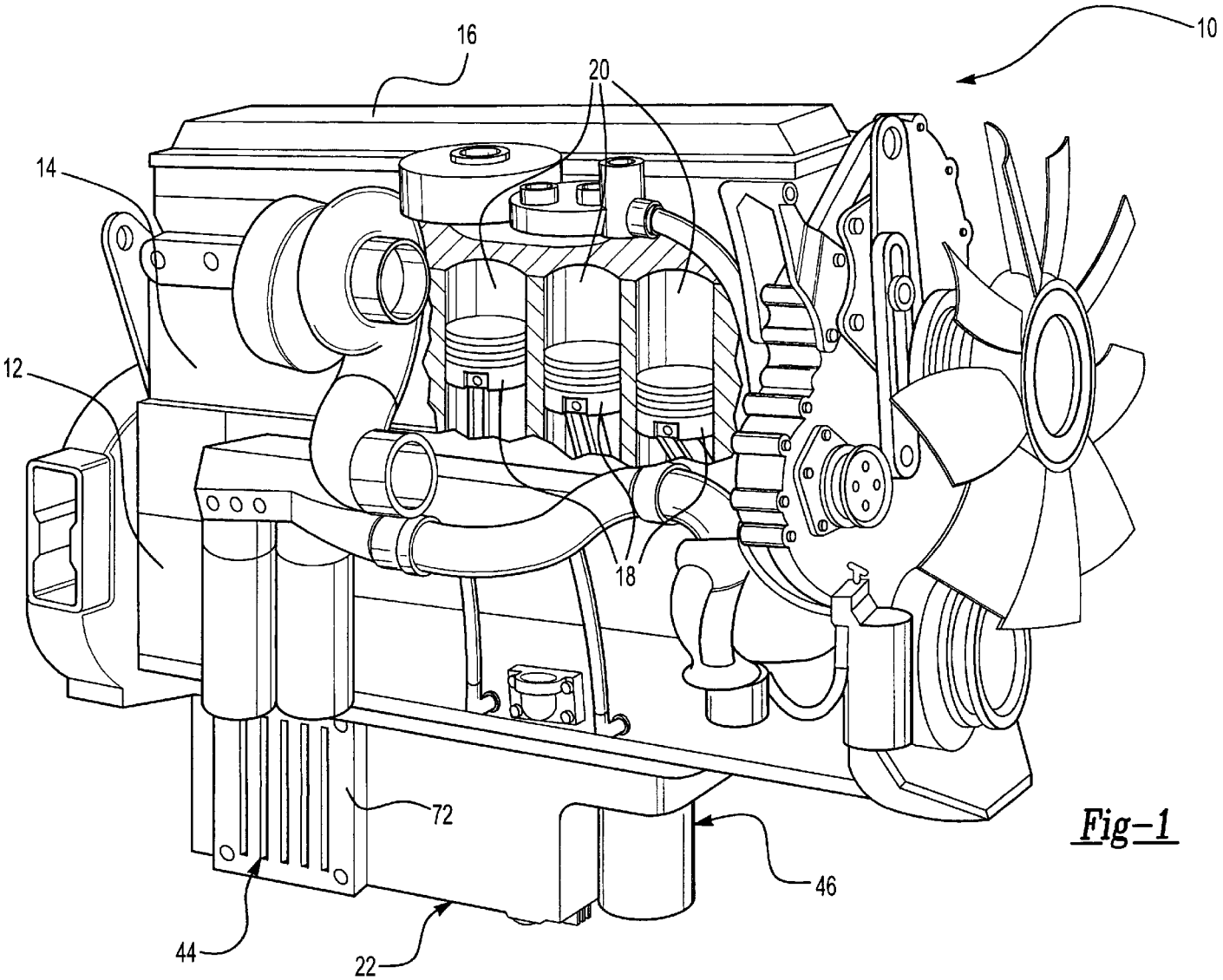
FIG. 1 is a perspective view partially cut away to illustrates pistons reciprocal within cylinders of an internal combustion engine and featuring the oil pan of the present invention.

Referring now to the drawings, wherein like numerals depict like structures, and particularly to FIG. 1, there is disclosed what in many respects is a conventional internal combustion engine, generally indicated at 10. In the preferred embodiment, the engine 10 would be a compression ignition or diesel engine, but those having ordinary skill in the art will appreciate that the engine 10 may also be a spark ignition engine. The engine 10 includes a cast (typically iron) engine block 12, a head 14 mounted to the engine block 12 and a valve cover 16 fastened to the head. A plurality of pistons 18 are reciprocated in cylinders 20 formed in the engine block 12. Similarly, a plurality of valves (not shown) supported in head 14 are opened and closed via rocker arms, cams or some other mechanism to provide fluid communication between the cylinders 20 and intake and exhaust manifolds as is commonly known in the art. Fuel is combusted within the cylinders 20 to reciprocate the pistons 18 which, in turn, act on a crankshaft from which power may be translated to drive an automotive vehicle or any number of other devices. The engine 10 also includes a number of other conventional components that are commonly known in the art and will not be described in detail here.

As alluded to above, the various moving parts of an internal combustion engine 10 need to be lubricated and cooled. To this end, coolant is circulated through the engine block 12 and lubricant, such as engine oil, is splashed over the moving parts. The lubricant may be an organic oil, synthetic oil, or any other type of fluid lubricant. However, it should be noted that the particulars of the lubricant are not important for purposes of the present invention and those having ordinary skill in the art will appreciate that a number of different fluid lubricants may be employed without departing from the scope of the present invention. Lubricant moves through the engine 10 and due to the force of gravity is collected in an oil pan, generally indicated at 22 which is fixed to the underside of the engine block 12 as will be discussed in greater detail below.

Figure 2:
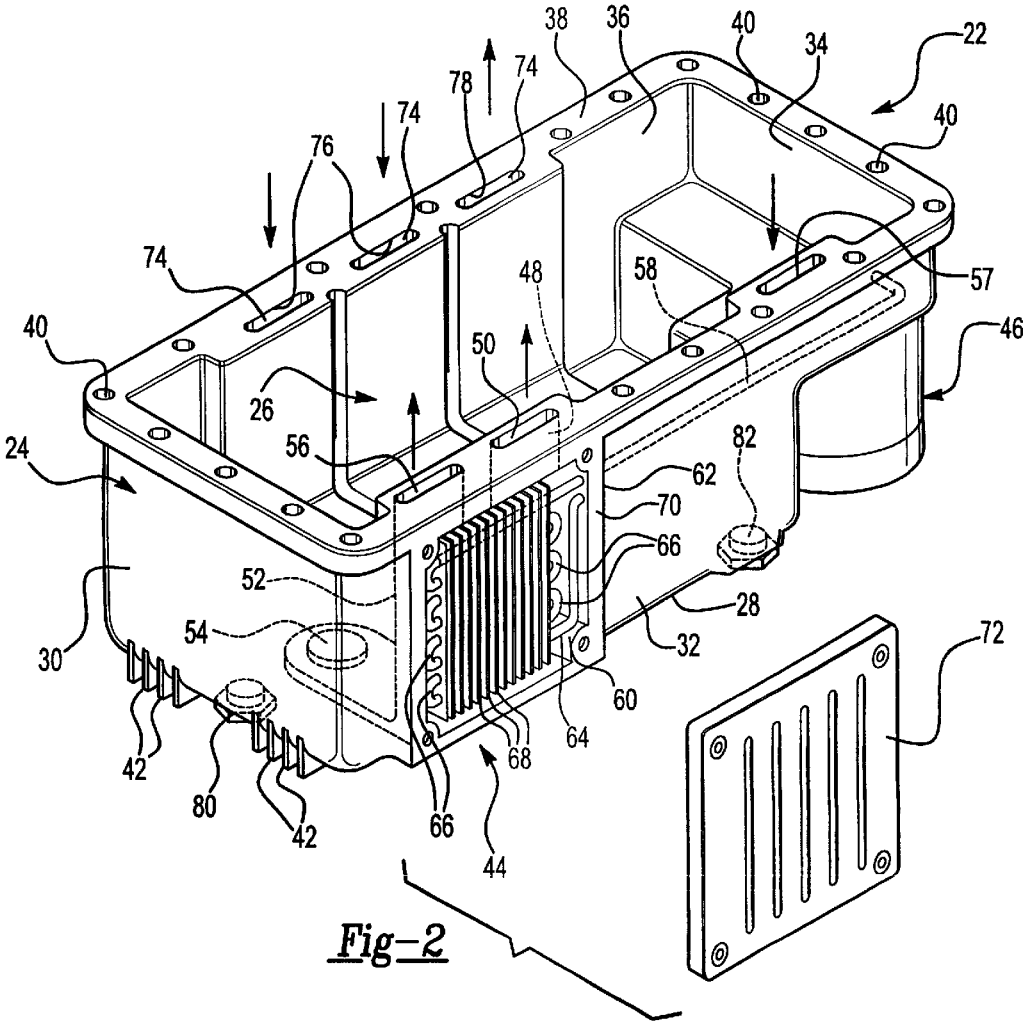
FIG. 2 is a perspective view of an oil pan with integrated oil filtration and cooling systems of the present invention.

In conjunction with FIG. 1, the structural oil pan of the present invention is generally indicated at 22 in FIG. 2. The oil pan 22 includes a cast, aluminum body, generally indicated at 24, which defines a reservoir 26 for collecting engine coolant. Those skilled in the art will immediately recognize that other light weight materials, such as magnesium, can also be used to make the oil pan. The reservoir 26 forms a receptacle for the lubricant and has a bottom 28 and side walls 30, 32, 34, and 36 extending upwardly from the bottom 28 to present a flanged lip 38 through which the oil pan 22 may be mounted to the engine. To this end, the flanged lip 38 also includes a plurality of apertures 40 adapted to receive fasteners, such as bolts (not shown), which are employed to mount the oil pan 22 to the underside of the engine block 12. The engine block 12 has a confronting surface which is adapted to engage the flanged lip 30 in abutting relationship. A gasket is interposed between the flanged lip 38 and the underside of the engine block 12 to effect a tight seal.

While the oil pan 22 depicted in the Figures has what has been identified as four side walls and is generally rectangular in shape, those having ordinary skill in the art will appreciate that the oil pan 22 of the present invention may take on any other geometric shape and have any number of side walls of varying sizes and shapes as may be dictated by the application, engineering convention or the internal combustion engine and that any such differences in size and shape between such an oil pan and the present invention as discussed below are not material.

The body 24 of the oil pan includes a plurality of stiffening ribs 42 formed on the bottom 28 of the reservoir 26. It is also contemplated that ribs may be formed on the side walls of the oil pan, and that they would be oriented perpendicularly to the side walls. The stiffening ribs 42 are disposed at parallel, spaced relationship with respect to one another for strengthening the body 24 and for dissipating heat from the oil pan. The oil pan 22 also includes an oil cooler assembly, generally indicated at 44, housed within the body 24 of the oil pan 22 for cooling lubricant received from the engine. In addition, the oil pan 22 of the present invention also includes an oil filter 46 removably mounted to the body 24. The body 24 includes at least one, but possibly more than one, oil inlet passage 48 formed integrally therewith for receiving lubricant from the engine 10 and for delivering lubricant to the oil filter assembly 46. The oil is then routed through an internal passage in the pan to the oil cooler 44. To this end, the oil inlet passage 48 has an opening 50 formed in the flanged lip 38 which is in fluid communication with a similar opening in the engine block 12 for the purposes of routing the cooled and filtered oil back to the engine.

Similarly, the body 24 also includes an oil pick up passage 52 formed integrally therewith and providing fluid communication between the reservoir 26 and the engine 10 through the flanged lip 38. The pick up passage 52 has an inlet 54 formed in the bottom 28 of the reservoir 26 and at least one outlet 56 formed in the flanged lip 38 of the body 24. A strainer may also be employed at the inlet 54 to the pick up passage 52 to further filter the oil flowing through the lubrication system of the engine 10. This arrangement eliminates several commonly used oil pick-up tubes, brackets, seals and fasteners that are typical for internal combustion engines. An oil pump (not shown) is employed to pump the oil from the reservoir 26 through the pick up passage 52 and into the engine 10. The oil pan 22 also includes oil filter passages 58 formed integrally with the body 24 and providing fluid communication for lubricant traveling between the oil the oil filter 46 and cooler assembly 44.

The oil cooler assembly 44 is housed within a cavity 60 formed in the body 24 and includes an inlet 62 in fluid communication with the oil passage 48. Tubing 64 is bent to form a circuitous path having hairpin turns 66. In addition, a plurality of elongated fins 68 are interposed between the tubing 64 and disposed at regularly spaced intervals relative to one another. An outlet 50 is in fluid communication with the engine 10. In this way, lubricant flows through the circuitous tubing 64 such that heat is transferred from the lubricant to the ambient surroundings via the elongated fins 68 prior to being routed to the engine 10 via the oil passage 50. A slotted cover 72 is removably mounted to the body 24 so as to cover the cavity 60. The oil drain bolt 80 is employed to allow access to the reservoir 26 for draining it of lubricant.

In addition, the body 24 also includes coolant passages 74 formed integrally therewith and traversing at least a portion of the body 24. The coolant passages 74 have at least one inlet 76 and at least one outlet 78. These inlets and outlets 76, 78 are formed in the flanged lip 38 to provide fluid communication for engine coolant between the engine and the coolant passages 74 extending through the body 24. The coolant passages 74 wrap around the side walls and bottom of the oil pan which increase heat transfer from the oil to the coolant for improved engine warm up characteristics. A coolant drain bolt 82 is also located in the bottom of the pan in communication with the coolant passages 74 for draining coolant from these passages 74 in the body 24 of the oil pan 22.

The coolant and lubricant that are conducted through the body 24 of the oil pan 22 via their respective passages serve to deaden engine noise. The oil pick up 52, oil inlet 48 and oil filter 58 and 51 passages as well as the coolant passages are all cast or cored into the aluminum body 24 of the oil pan 22. These passages serve to strengthen and stiffen the oil pan such that the natural vibration frequencies for the oil pan 22 are shifted out the excitation frequency range for the engine.

At the same time, a number of components and subcomponents normally associated with the oil cooler and oil filter systems employed in the related art have been eliminated. More specifically, the present invention eliminates the need for a separate oil cooler and oil filter housing supported remote form the oil pan via associated brackets and fasteners as well as the tubing and seals required to interconnect the oil coolers and the oil filters of the related art with other components in the engine. The integrally formed passages in the body 24 of the oil pan 22 of the present invention also minimizes the opportunity for external leaks when compared with conventional oil pans. Thus, the oil pan 22 of the present invention not only reduces engine noise radiated from the oil pan, it also results in fewer components, increased manufacturing efficiencies and thereby reduces overall costs for the engine 10 employing an oil pan 22 of the present invention.

Figure 3:
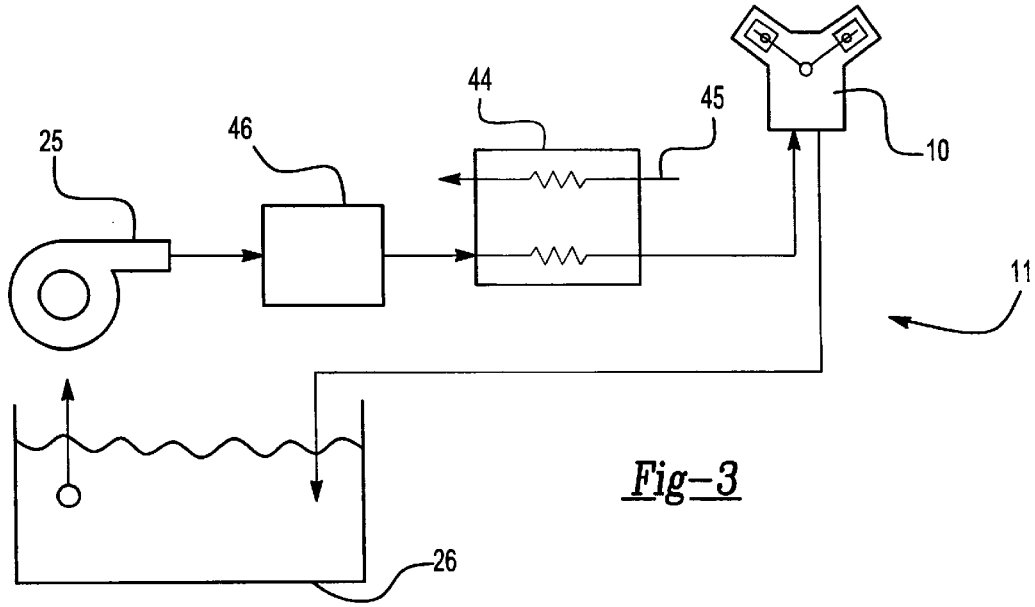
FIG. 3 is a schematic view of the oil circuit contemplated by the present invention.

Turning now to FIG. 3, there is shown therein a schematic of the oil flow circuit 11 contemplated in the invention. Oil is transported from the reservoir through the oil pump 25 and conveyed through the oil filter 46 to the oil cooler 44. Engine coolant 45 is moved through the oil cooler, thereby cooling the oil that travels through the cooler. The cooled, filtered oil is pumped to the engine 10, where, after completing its circuit through the oil passages in the engine, is sent hot and unfiltered back to the reservoir 26 to complete the circuit.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

I claim:

1. An oil pan for an internal combustion engine, said oil pan comprising:

a body defining a reservoir for collecting engine lubricant, said reservoir having a bottom and side walls extending upwardly from said bottom to present a flanged lip through which said oil pan is mounted to the engine;

an oil cooler assembly housed within said body of said oil pan for cooling lubricant received from the engine;

said body including an oil inlet passage formed integrally therewith for receiving lubricant from the engine and for delivering lubricant to the said oil cooler assembly; and said body further including an oil pick up passage formed integrally therewith providing fluid communication between said reservoir and the engine through said flanged lip.

2. An oil pan as set forth in claim 1 further including an oil filter removably mounted to said body and oil filter passages formed integrally with said body and providing fluid communication for lubricant traveling between said oil cooler assembly and said oil filter.

3. An oil pan as set forth in claim 2 wherein said oil cooler assembly is housed within a cavity formed in said body and includes an inlet in fluid communication with said oil inlet passage, tubing bent to form a circuitous path having hairpin turns and a plurality of elongated fins interposed between said tubing and disposed at regularly spaced intervals relative to one another, an outlet in fluid communication with said oil filter passage, and wherein the lubricant flows through said circuitous tubing such that heat is transferred from the lubricant to the ambient surroundings via said elongated fins.

4. An oil pan as set forth in claim 3 wherein said body includes a cover removably mounted thereto so as to cover said cavity.

5. An oil pan as set forth in claim 1 wherein said body includes coolant passages formed integrally therewith and traversing at least a portion of said body, said coolant passages having at least one inlet and at least one outlet, said at least one inlet and outlet formed in said flanged lip to provide fluid communication for engine coolant between the engine and said coolant passages extending through said body.

6. An oil pan as set forth in claim 1 wherein said pick up passage has an inlet formed in said bottom of said reservoir and at least one outlet formed in said flanged lip of said body for providing fluid communication for the lubricant between said reservoir and the engine.

7. An oil pan as set forth in claim 1 wherein said body includes a plurality of stiffening ribs formed on said bottom of said reservoir and disposed at parallel spaced relationship with respect to one another for strengthening said body and for dissipating heat from said oil pan.

8. An oil pan as set forth in claim 1 wherein said body is made of cast aluminum.

9. An internal combustion engine comprising:

an engine block and an oil pan;

said oil pan including a body defining a reservoir for collecting engine lubricant, said reservoir having a bottom and side walls extending upwardly from said bottom to present a flanged lip through which said oil pan is mounted to said engine block;

an oil cooler assembly housed within said body of said oil pan for cooling lubricant received from the engine;

said body including an oil inlet passage formed integrally therewith for receiving lubricant from the engine and for delivering lubricant to the said oil cooler assembly; and said body further including an oil pick up passage formed integrally therewith providing fluid communication between said reservoir and the engine through said flanged lip.

10. An oil pan as set forth in claim 9 further including an oil filter removably mounted to said body and oil filter passages formed integrally with said body and providing fluid communication for lubricant traveling between said oil cooler assembly and said oil filter.

11. An oil pan as set forth in claim 10 wherein said oil cooler assembly is housed within a cavity formed in said body and includes an inlet in fluid communication with said oil inlet passage, tubing bent to form a circuitous path having hairpin turns and a plurality of elongated fins interposed between said tubing and disposed at regularly spaced intervals relative to one another, an outlet in fluid communication with said oil filter passage, and wherein the lubricant flows through said circuitous tubing such that heat is transferred from the lubricant to the ambient surroundings via said elongated fins.

12. An oil pan as set forth in claim 11 wherein said body includes a cover removably mounted thereto so as to cover said cavity.

13. An oil pan as set forth in claim 9 wherein said body includes coolant passages formed integrally therewith and traversing at least a portion of said body, said coolant passages having at least one inlet and at least one outlet, said at least one inlet and outlet formed in said flanged lip to provide fluid communication for engine coolant between the engine and said coolant passages extending through said body.

14. An oil pan as set forth in claim 9 wherein said pick up passage has an inlet formed in said bottom of said reservoir and at least one outlet formed in said flanged lip of said body for providing fluid communication for the lubricant between said reservoir and the engine.

15. An oil pan as set forth in claim 9 wherein said body includes a plurality of stiffening ribs formed on said bottom of said reservoir and disposed at parallel spaced relationship with respect to one another for strengthening said body and for dissipating heat from said oil pan.

16. An oil pan as set forth in claim 9 wherein said body is made of cast aluminum.

* * * * *

UNITED STATES PATENT AND TRADEMARK OFFICE

CERTIFICATE OF CORRECTION

PATENT NO. : 6,058,898
DATED : May 9, 2000
INVENTOR(S) : Charles E. Freese, V

It is certified that error appears in the above-identified patent and that said Letters Patent is hereby corrected as shown below:

Column 1,
Line 5, after "BACKGROUND OF THE INVENTION", insert -- This invention was made with Government support under DE-FC05-97 OR22581 awarded by the United States Department of Energy. The Government has certain rights in this invention. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*